United States Patent [19]

Brandl

[11] Patent Number: 4,953,916

[45] Date of Patent: Sep. 4, 1990

[54] DRIVE ARRANGEMENT FOR DRIVING CUTTING ROLLS

[75] Inventor: Erich Brandl, Grosslobming, Austria

[73] Assignee: Voest-Alpine Maschinenbau Gesellschaft M.B.H., Linz, Austria

[21] Appl. No.: 268,771

[22] Filed: Nov. 9, 1988

[30] Foreign Application Priority Data

Nov. 11, 1987 [AT] Austria ..... 2982/87

[51] Int. Cl.[5] ..... E21C 25/08

[52] U.S. Cl. ..... 299/76; 299/89

[58] Field of Search ..... 299/71, 73, 75, 76, 299/78, 80, 89; 179/91; 29/124, 125

[56] References Cited

U.S. PATENT DOCUMENTS

| | | | |
|---|---|---|---|
| 3,157,437 | 11/1964 | Gonski | 299/89 X |
| 3,712,679 | 1/1973 | Amoroso | 299/80 X |
| 3,848,930 | 11/1974 | LeBegue | 299/76 |
| 4,270,803 | 6/1981 | Baum | 299/76 |
| 4,310,199 | 1/1982 | Freed, Jr. et al. | 299/76 |

FOREIGN PATENT DOCUMENTS

| | | | |
|---|---|---|---|
| 164002 | 8/1964 | U.S.S.R. | 299/89 |
| 539144 | 12/1976 | U.S.S.R. | 299/89 |
| 840347 | 6/1981 | U.S.S.R. | 299/75 |

*Primary Examiner*—Jerome W. Massie, IV
*Assistant Examiner*—David J. Bagnell
*Attorney, Agent, or Firm*—Cushman, Darby & Cushman

[57] ABSTRACT

In a rotationally driven cutting roll for a machine for cutting ore or other rock material from a drift face, the roll is axially divided into a plurality of roll portions arranged end to end in juxtaposition along the drift face. The roll portions are rotationally driven by a continuous, one-piece straight driving shaft. Lateral ones of the roll portions are supported coaxially with the shaft, but the medial roll portion or portions is or are supported in respective inclined positions relative to the longitudinal axis of the driving shaft. As a result, gearing ribs on the drift face are minimized in width.

9 Claims, 3 Drawing Sheets

DRIVE ARRANGEMENT FOR DRIVING CUTTING ROLLS

BACKGROUND OF THE INVENTION

1. Field of the Invention

The invention refers to a driving arrangement for driving cutting rolls, e.g. of a mining machine in which arrangement the cutting roll means is, in direction of the axis of rotation, subdivided into a plurality of axially adjoining sections or portions and the cutting roll portions are, for the purpose of reducing the distance of adjacent cutting roll portions at the drift faced of the ore vein or other rock arranged at an angle relative to the axial position within the area of the bearing means and the drive means.

2. Description of the Prior Art

Known driving arrangements for cutting rolls, for example the arrangement having become known from U.S. Pat. No. 4,225,189, provide for cutting rolls which are subdivided in the axial direction of the driving shaft, in which arrangement the central section, consisting of two cutting rolls, can be telescopically enlarged in its width. For this purpose, the carriers must laterally be expanded in a telescoping manner and, for the purpose of obtaining a narrow gearing rib at the drive connection and at the bearing support of the cutting head portions, both outer cutting heads are angularily designed. It is a drawback of such an arrangement that the capability of telescoping movement within the central area has the unavoidable consequence of laterally shifting the carriers. The space remaining laterally of the machine and behind the roll is, on account of the construction, restricted. Thus, there remains always only little space for consolidating work, in particular for placing anchors in proximity to the drift face. The rotary coupling between the roll portions arranged at an angle one relative to the other is effected by means of gear rims arranged on the circumference of the roll, and, on account of the dust-laden atmosphere in proximity to the drift face, this rotary coupling is subject to great water.

From U.S. Pat. No. 3,848,930, there has already become known a type of a driving arrangement, in which both of the outer roll portions are equally arranged at an angle relative to the central roll portion. The transmission of rotation for driving the outer roll portions is effected via a universal joint of the driving shaft and gearing traction must be arranged around the universal joint for preventing any overload of the articulated driving shaft at the universal joint. Such a construction permits only a cutting roll having a small outer width and, a telescoping means which has become known in other arrangements can not easily be realized in such an arrangement.

SUMMARY OF THE INVENTION

The invention provides a stable driving connection of simple construction, in which the cutting edge of a segmented cutting roll is interrupted for an only small extent widthwise at the drift face, by the unavoidable present gearing rib and which provides the possibility to provide telescoping devices known per se, in particular at the outer rolls. For solving this task, the driving arrangement according to the invention essentially consists in that the driving shaft for the roll portions is of straight-lined design and is preferably designed as one single part. The driving shaft is connected with at least one roll portion inclined out of coaxial relation, and with at least one roll portion being coaxially arranged relative to the driving shaft. On account of the driving shaft for the roll portions being, according to the invention, of straight-lined design, one can do without universal joints interconnected with the driving shaft, so that it is, without difficulties, possible to effect force-transmission without overloading such joints. On account of at least one roll portion being arranged in an inclined position relative to a coaxial relationship with the drive shaft, despite the driving shaft being of straight-lined and one-piece design, the gap remaining at the drift face at the area of the bearing means or drive gearing can be reduced on account of such an inclined position, so that a cutting contour can be provided which is substantially free of interruption. The arrangement comprising a continuous straight-lined driving shaft further provides the possibility of providing, in a simple manner, a telescoping device which may be incorporated in a simple manner into the cutting roll means.

For now, providing the possibility to incorporate a telescoping device into the outer rolls and, despite that, to keep the driving connection one that is of simple design, the arrangement is, according to the invention, advantageously selected such that the roll portions are supported on a fork-shaped roll carrier and such that the roll adjoining the bearing means in inward direction to the middle of the length is subdivided into two roll portions, the generatrices of which include at the side facing the drift face a blunt angle with the tip facing the drift face. On account of the roll means, which is arranged within the fork-shaped roll carrier, being subdivided into two roll portions and on account of these both roll portions being supported in respective inclined positions, a reliable rotational support for these roll portions can be provided on the straight-lined continuous driving shaft. The inclined positions provided for the rolls within this area provides the possibility to keep the gearing rib as small as possible without being obliged to forego the advantages of a straight-lined continuous driving shaft which is preferably designed in one piece.

In this case, the arrangement is advantageously such that the roll portions adjoining the bearing means and/or the drive means in outward direction are coaxially arranged relative to the driving shaft. This coaxial arrangement of the outwardly adjoining roll portions allows the installation of usual telescoping devices. When telescopically extending these roll portions laterally adjoining at the outer side, the carrier remains, together with the drive means and the gearing, in its unchanged position relative to the inner roll portions, so that the lateral space for consolidating the drift is increased when telescopically extending the laterally adjoining roll portions.

For the purpose of obtaining a cutting contour having, as much as possible, a straight-lined shape, the arrangement is advantageously such that the tip, facing the drift face, of the generatrices of the inner roll portions is approximately in alignment with the generatrices of the laterally adjoined coaxial roll portions. The bits of the roll portions assuming inclined position are advantageously oriented in the longitudinal direction of the generatrices for the purpose of obtaining a substantially cylindrical enveloping surface at the side facing the drift face. For the purpose of obtaining a substantial cylindrical enveloping surface at the drift face in a reliable manner in case of drum-shaped cutting roll bodies having a substantially cylindrical mantle surface, bit carriers or bit holders of different size must be provided over the axial length of the roll. In place of such drum-shaped cutting roll portions, the arrangement can advantageously be selected such that the roll portions assuming inclined positions are conically designed. Identical constructional parts for the bits and the bit holders may be utilized in a simple manner without loss of the advantage of a cylindrical enveloping surface at the drift face.

According to a further development of the driving arrangement according to the invention, the roll portions assuming inclined positions are connected for rotation with the driving shaft via universal joints. In this arrangement, the universal joints are only loaded by the momentum of a roll portion and are not included into the whole gearing traction. The rotary connection of the roll portions via universal joints is, furthermore, effected at a substantially greater diameter then would be possible in a universal joint in the driving shaft. The occurring cutting forces can be resisted on such a greater diameter in a substantially more simple manner than on the relatively small diameter of the driving shaft.

In this case, the arrangement is in a particularly simple manner selected such, that the universal joints comprise a first ring or hub mounted for rotation with the driving shaft and having two mutually diametrically opposite bearing locations, in particular bearing pins. A universal joint ring is swivelably connected to the bearing locations, in particular to the bearing pins. Bearing locations, in particular bearing pins, extending in substantially orthogonal relation to the axis of the first bearing locations. A drive member is connected with the cutting roll portion and acts for being rotated on the further bearing locations of the universal joint ring. Such a design of universal joint provides for a stable design of the bearing means over a great length of the bearing and on the central driving shaft, so that great cutting forces can reliably be transmitted not only with consideration of the transmission of momentum, but are also received by the bearing means in a safe manner.

As already mentioned, the inclined positions of both inner rolls makes possible the preferred arrangement, in which the outer rolls which are substantially coaxially arranged relative to the driving shaft are designed for telescoping movement, so that, when telescoping the cutting roll means, the consolidating work, until near the drift face, is in no manner obstructed, but, to the contrary, the space offered for such consolidating work is increased behind the roll.

According to a preferred embodiment, the driving shaft of the cutting roll portions can be bearingly supported at both sides of the inclined rolls between one roll portion assuming an inclined position and a roll portion coaxially arranged relative to the shaft and, optionally, be driven at both bearing locations. When using two drive means, the space required for the gearing can be further reduced and the gear rib remaining in proximity of the drift face can be reduced in size.

BRIEF DESCRIPTION OF THE DRAWINGS

In the following text, the invention is further explained with reference to examples of embodiments schematically shown in the drawings.

In the drawings.

DETAILED DESCRIPTION OF THE PREFERRED EMBODIMENTS

Figure 1:
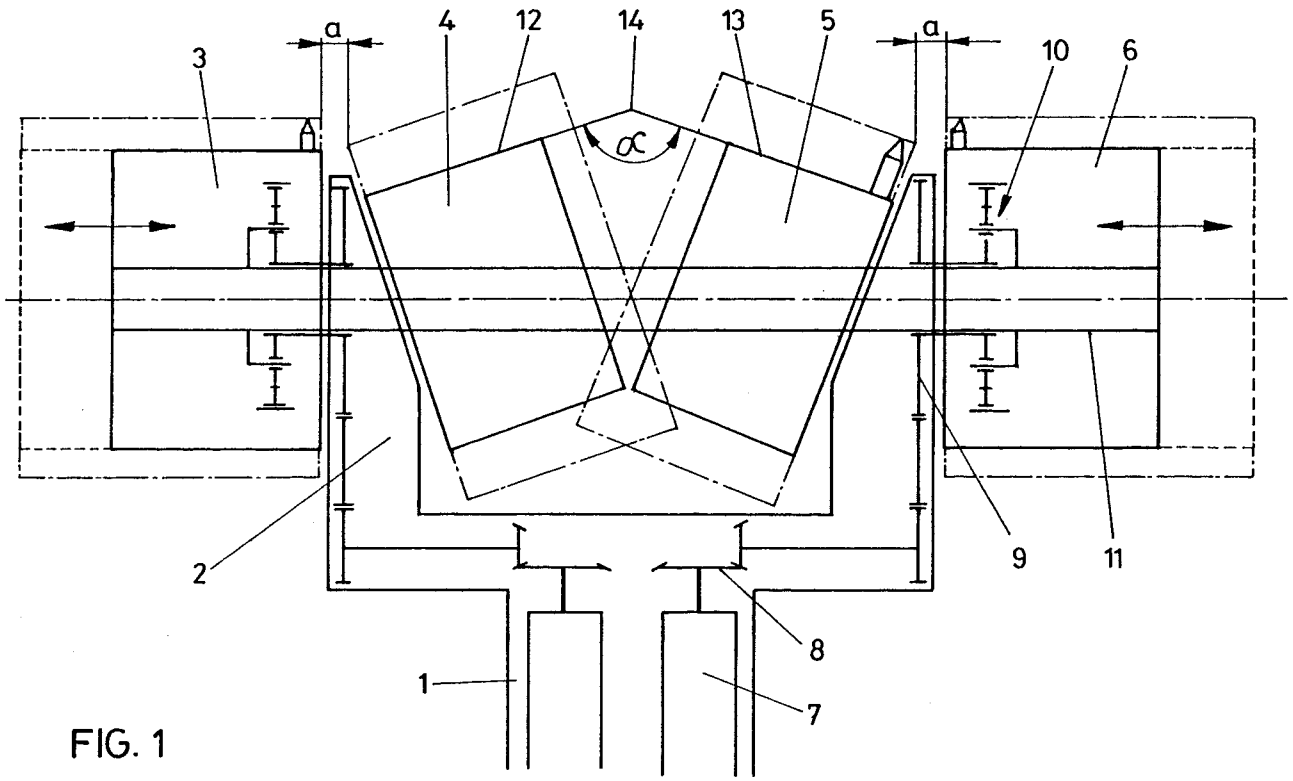
FIG. 1 shows a schematic top plan view of the front end of a carrier arm for a plurality of cutting roll portions which are provided, arranged, mounted and being driven according to principles of the invention.

In FIG. 1, there is shown a fork-shaped carrier 1, the fork arms 2 of which contain the bearing means and the drive means for the cutting roll portions 3, 4, 5 and 6. The drive means is schematically indicated by two drive motors 7, which make it possible to rotate a continuous and straight-lined drive shaft 11 of one-piece design, via bevel gears 8 and spur gears 9 and via a reduction gearing 10 arranged within the interior of the outwardly arranged cutting roll portions 3, 6. This reduction gearing may, in a usual manner, be designed as a rotary spur gearing. Said four cutting roll portions 3, 4, 5 and 6 are supported on this continuous, one-piece driving shaft 11 for rotation therewith. The bearings for the driving shaft 11 are provided within the fork arms 2 of the carrier 1.

Both of the outwardly arranged cutting roll portions 3 and 6 are, in a manner known per se and not shown in detail, designed for telescoping movement and are directly driven by the reduction gearing 10 or, via the driving shaft 11. Between the fork arms 2, there is used for the purpose of reducing the gearing gaps a at the side facing the drift face, a cutting roll consisting of the both cutting roll portions 4 and 5, which ared arranged in respective inclined positions relative to the axis of the drive shaft 11. The inclined position is such that the generatrices 12 of the mantle of the roll portion 4 and, respectively, the generatrices 13 of the mantle of the roll portion 5 intersect one another at the drift face under a blunt (i.e., $\alpha$ obtuse), the tip 14 of this angle $\alpha$ directed towards the drift face. For the purpose of connecting such roll portions 4 and 5 of inclined position for rotation with a straight, continuous one-piece driving shaft 11 in a reliable manner, there are used universal joints which are explained with greater detail below in relation to FIGS. 2 and 3.

Figure 2:
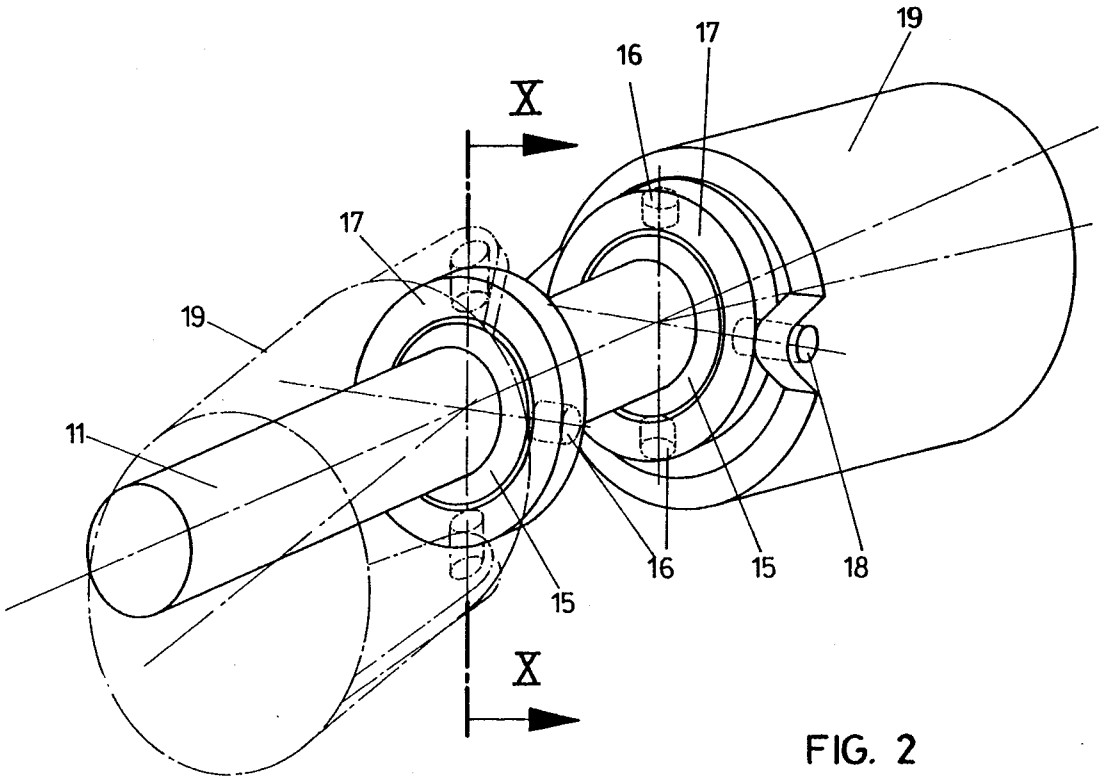
FIG. 2 shows a perspective view of the connecting joint for the rotating drive means of the cutting roll portions which are arranged in respective inclined positions.

In FIG. 2, there is schematically illustrated the construction of such a universal joint. The continuous driving shaft is again designated by the reference numeral 11, and a first inner ring 15 is shown connected for rotation with this driving shaft 11. In the representation according to FIG. 2, there are shown two such rings 15, which, however, might easily be designed as a common hub as is shown in FIG. 3.

The rings 15, which are connected with the shaft 11 for rotation therewith, carry at mutually diametrially opposite locations bolts or pins 16 for connecting a universal joint ring 17. This universal joint ring 17 itself carries bearing locations or bearing pins 18, which are orthogonally displaced relative to the bearing locations of the pins 16. The drive members 19 in a manner such as to transmit the rotating movement on the bearing locations or bearing pins 18. The drive members 19 are connected, for transmitting rotating movement, with the respective drum mantle of the roll portions 4 and 5 of FIG. 1.

Figure 3:
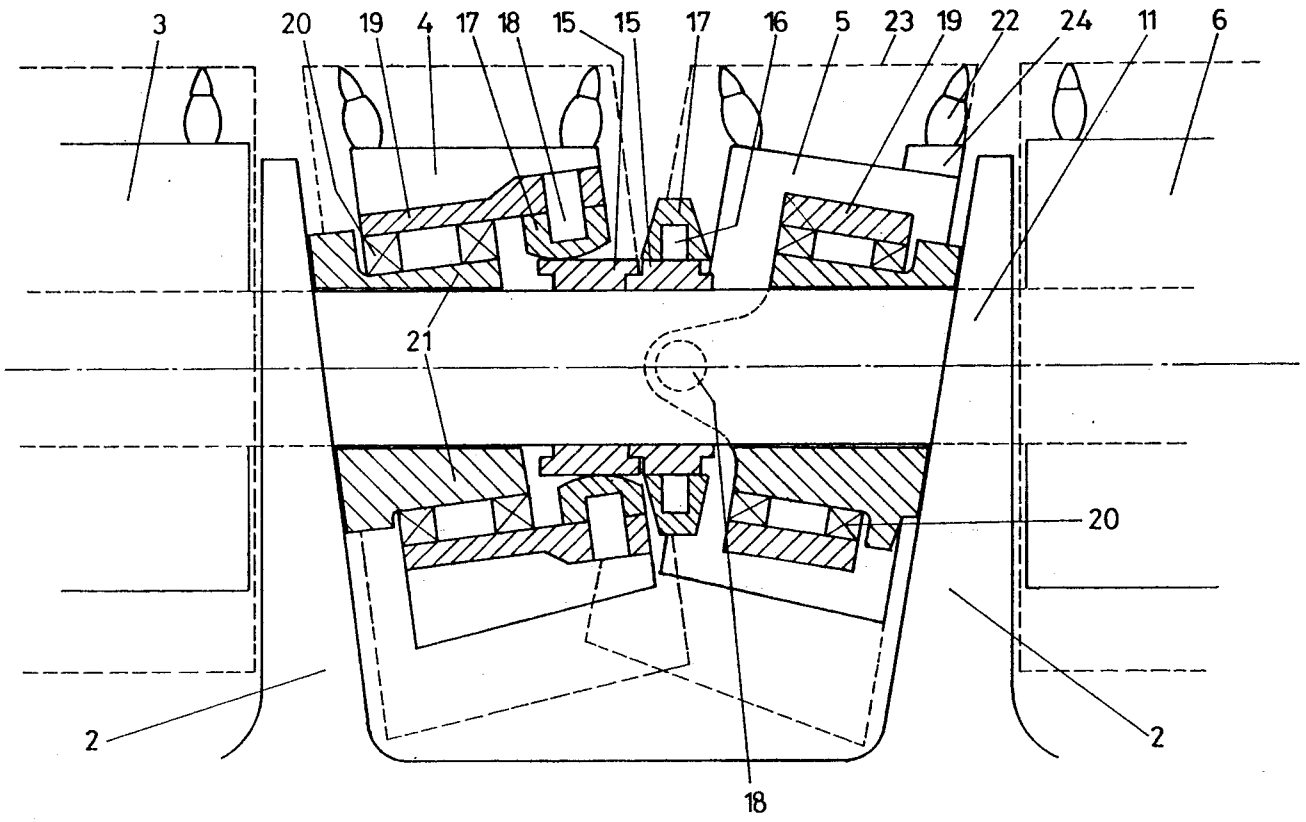
FIG. 3 shows a modified embodiment of the rotating drive means for the inclined cutting roll portions, in a section corresponding substantially to the section line X—X indicated in FIG. 2.

A further illustration of the bearing means of the roll portions 4 and 5 can be taken from FIG. 3. In the embodiment according to FIG. 3, the inner ring is designed as a hub, which is again designated by the reference numeral 15. The universal joint 17 is, as can be seen in FIG. 3, provided with an inner contour providing the possibility of swiveling the universal joint 17 around the pins 16 without colliding with the hub. The roll portions 4 and 5 are bearingly supported on the continuous one-piece driving shaft 11 by means of obliquely arranged bearings 20, which are supported on the gearing housing with interposition of carrier members 21 arranged at a distance from the driving shaft 11. The enveloping curve of the bits 22 is schematically designated by the reference numeral 23. This enveloping curve 23 corresponds, in the representation according to FIG. 3, to a section through the drift face. For this purpose, the bits 22 must, in case of a cylindrical mantle of the cutting roll portions 4 and 5, be fixed on different bit holders over the axial length of the respective mantle. Such a bit holder is schematically indicated by the reference numeral 24. Alternatively, the mantle of the cutting roll portion 4 can, as is for example indicated for the cutting roll portion 4, be conically designed, so that there results a substantially cylindrically enveloping curve at the drift face and thus a straight cutting edge in correspondence with the line 23 when using substantially identical constructional parts for the bit holders 24 or the bits 22.

The universal joint ring 17 is for mounting purposes divided, which is not shown in the drawings.

What is claimed is:

1. A rotary cutting roll arrangement for a machine for cutting material from a drift face having a width, comprising:

a straight drive shaft arranged to be supported for rotation about its own longitudinal axis with said axis extending widthwise of the drift face;

a cutting roll means having a radially outer periphery provided with a plurality of axially and angularly spaced cutting bits; said cutting roll means being divided into a plurality of cutting roll portions juxtaposed end to end in a series and mounted by respective mounting means on said drive shaft for rotation therewith; said cutting roll portions including at least two laterally outer portions respectively flanking two more medial portions;

said mounting means for said laterally outer cutting roll portions mounting said laterally outer cutting roll portions coaxially with one another and with said drive shaft; and said mounting means for said two more medial cutting roll portions being constituted by respective universal joint means which mount respective ones of said two more medial cutting roll portions on said drive shaft;

said two more medial cutting roll portions having respective one ends disposed proximally of one another, and respective other ends disposed distally of one another, said universal joint means being so located relative to said one ends as to predispose said two more medial cutting roll portions to remain disposed in use with their longitudinal axes at an obtuse angle to one another.

2. The rotary cutting roll arrangement of claim 1, wherein:

each said universal joint comprises: p2 a first ring mounted on said drive shaft for rotation therewith;

each said first ring having two diametrically opposed, radially extending first bearing pins mounted thereon;

a universal joint ring swivelably mounted to said first ring by said first bearing pins;

each said universal joint ring having two diametrically opposed, radially extended second bearng pins mounted thereof so as to extend in substantially orthogonal relation to said first bearing pins; and a drive member swivelably mounted to said universal joint ring by said second bearing pins;

each said more medial cutting roll portion being mounted on a respective said drive member.

3. The rotary cutting roll arrangement of claim 2, wherein:

said two more medial cutting rolls, exclusive of said cutting bits thereof are each substantially cylindrical in radially outer peripheral shape so as to jointly present a generatrix forwardly in use, which generatrix is a bent imaginary line subtending an obtuse angle which is blunt towards said drift face and made of two limbs which are inclined at opposite angles to said longitudinal axis of said drive shaft.

4. The rotary cutting roll arrangement of claim 1, further comprising:

a fork-shaped roll carrier having two arms provided with bearings respectively supporting said drive shaft at locations between respective of said other ends of said two more medial cutting roll portions and respective of said laterally outer cutting roll portions, for rotation about said longitudinal axis of said drive shaft.

5. The rotary cutting roll arrangement of claim 4, wherein:

means associated with said arms of said fork-shaped roll carrier for rotating all four of said cutting roll portions on said drive shaft.

6. The rotary cutting roll arrangement of claim 5, wherein:

said means for rotating said cutting roll portions comprises motor means mounted on said fork-shaped roll carrier, and gearing means drivingly connecting said motor means with said shaft.

7. The rotary cutting roll arrangement of claim 1, wherein:

said laterally outer cutting rolls, exclusive of said cutting bits thereon, upon being rotated in use, generate respective envelopes of movement which includes respective segments of a forwardly presented substantially straight imaginary line which extends widthwise of the drift face; and said two more medial cutting roll portions, exclusive of said cutting bits thereon, upon being rotated in use generate respective envelopes of movement which include, at said one ends thereof, respective points which lie substantially on said substantially straight imaginary line adjacent one another and both between said segments of said substantially straight imaginary line.

8. The rotary cutting roll arrangement of claim 7, wherein:

said two more medial cutting roll portions, inclusive of said cutting bits thereon are frusto-conical in radially outer peripheral shape of rotational envelope;

said two laterally outer cuttings rolls, inclusive of said cutting bits thereon are cylindrical in radially outer peripheral shape of rotational envelope;

and all four of said cutting roll portions, inclusive of said cutting bits thereon, upon being rotated in use generate rotational envelopes having respective forwardly presented portions thereof coincident with respective segments of an imaginary straight line extending widthwise of the drift face.

9. The rotary cutting roll arrangement of claim 1, wherein:

said mounting means for said laterally outer cutting roll portions provide for longitudinal movement of said laterally outer cutting roll portions along said drive shaft while disposed to be rotated on said drive shaft about said longitudinal axis.

* * * * *